US006350012B1

(12) United States Patent
Sarkissian et al.

(10) Patent No.: US 6,350,012 B1
(45) Date of Patent: Feb. 26, 2002

(54) METHOD AND APPARATUS FOR CLEANING/MAINTAINING OF AN AIP TYPE PRINTHEAD

(75) Inventors: Shahin Sarkissian; Joy Roy, both of San Jose, CA (US); Foreshteh Lesani, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/340,741

(22) Filed: Jun. 28, 1999

(51) Int. Cl.[7] ..... B41J 2/165; B41J 2/135
(52) U.S. Cl. ..... 347/46; 347/33
(58) Field of Search ..... 347/23, 28, 29, 347/31, 33, 46

(56) References Cited

U.S. PATENT DOCUMENTS

| | | | | |
|---|---|---|---|---|
| 4,751,534 A | | 6/1988 | Elrod et al. | 347/33 |
| 5,027,134 A | | 6/1991 | Harmon et al. | 347/29 |
| 5,565,113 A | | 10/1996 | Hadimioglu et al. | 347/46 |
| 5,612,721 A | | 3/1997 | Ishize | 347/33 |
| 5,644,347 A | | 7/1997 | Schwiebert et al. | 347/33 |
| 5,793,390 A | | 8/1998 | Claflin et al. | 347/33 |
| 5,825,380 A | | 10/1998 | Ichizawa et al. | 347/28 |
| 5,969,731 A | * | 10/1999 | Michael et al. | 347/33 |

* cited by examiner

*Primary Examiner*—John Barlow
*Assistant Examiner*—An H. Do
(74) *Attorney, Agent, or Firm*—Fay, Sharpe, Fagan, Minnich & McKee, LLP

(57) ABSTRACT

In AIP printheads, misfunction after printing a number of prints, due to the accumulation of ink and dust around orifices in the orifice plate may occur. In order to clean the printheads, the dirty printhead is first capped and the ink pressure in the printhead increase significantly to allow ink to escape through the orifices and completely fill a small gap inside the cap portion. After letting the orifices soak for a predetermined time to dissolve the dried ink and loosen dust debris which may be found on the printheads, the cap drainhole is opened to drain the ink while keeping the ink pressure inside the head at an intermediate higher level. This higher pressure prevents the ink still remaining inside the bore of each orifice hole from reentering the printhead. The dirty ink remaining inside the orifice bore is removed using a wiping station in separate steps.

20 Claims, 8 Drawing Sheets

METHOD AND APPARATUS FOR CLEANING/MAINTAINING OF AN AIP TYPE PRINTHEAD

BACKGROUND OF THE INVENTION

This invention relates to acoustic ink printing and, more particularly to, a method and apparatus which allows for cleaning and maintaining AIP printheads which implement unique orifice plates.

It has been shown that acoustic ink printers which have printheads comprising acoustically illuminated spherical or Fresnel focusing lenses can print precisely positioned picture elements (pixels) at resolutions that are sufficient for high quality printing of complex images. Significant effort has gone into developing acoustic ink printing, see for example, U.S. Pat. Nos. 4,308,547; 4,751,530; 4,697,195; 4,751,530; 4,751,534; 5,028,937; and 5,041,849, all of which are among many commonly assigned to the present assignee.

Although acoustic lens-type droplet emitters currently are favored, there are other types of droplet emitters which may be utilized for acoustic ink printing, including (1) piezoelectric shell transducers, such as described in Lovelady et al., U.S. Pat. No. 4,308,547, and (2) interdigitated transducers (IDTs), such as described in commonly assigned U.S. Pat. No. 4,697,195. Furthermore, acoustic ink printing technology is compatible with various printhead configurations; including (1) singe emitter embodiments for raster scan printing, (2) matrix configured arrays for matrix printing, and (3) several different types of page and width arrays, arranging from (i) single row sparse arrays for hybrid forms of parallel/serial printing, (ii) multiple row staggered arrays with individual emitters for each of the pixel positions or addresses within a page width address field (i.e., single emitter/pixel/line) for ordinary line printing.

For performing acoustic ink printing with any of the aforementioned droplet emitters, each of the emitters launches a converging acoustic beam into a pool of ink, with the angular convergence of the beam being selected so that it comes to focus at or near the free surface (i.e., the liquid/air interface) of the pool. Moreover, controls are provided for modulating the radiation pressure which each beam exerts against the free surface of the ink. That permits the radiation pressure from each beam to make brief, controlled excursions to a sufficiently high pressure level to overcome the restraining force of surface tension, whereby individual droplets of ink are emitted from the free surface of the ink on command, with sufficient velocity to deposit them on a nearby recording medium.

A main attraction of acoustic ink printing is the ability to control droplet size based on the frequency of the signal provided, rather than providing on the size of the nozzle emitting the droplet. For example, an AIP printer may emit droplets magnitude in size smaller than the AIP openings. On the other hand, conventional ink jet printing requires a minimization of the nozzle itself to obtain small droplets.

While this is a benefit of AIP type printing, the size of the droplet ejectors used in acoustic ink printing are nevertheless very small. In consideration of this, maintaining the droplet ejectors in a clean state is an extremely important aspect of proper operation. Not only can dirt particles and dust (particularly paper dust) clog the ejector ports, but ejected ink droplets which do not adhere to the recording medium or have such low velocity that they return back to the orifice plate, and can build up enough to disrupt the printing process. Additionally, whereas many conventional ink jet printers require the replacement of the printheads after a somewhat short period of time, AIP printheads can have an indefinite life span. As part of extending this useful life, maintaining the printheads clean is an important aspect.

Existing examples of printhead cleaning are substantially directed to cleaning of printheads configured using the previously mentioned nozzles.

U.S. Pat. No. 4,340,897 discloses a cleaning device for an ink-jet writing head wherein the nozzles of the writing head are urged into contact with a manifold having a set of brushes thereon. Vacuum is applied through the brushes to remove excess ink from the nozzles.

U.S. Pat. No. 4,546,363 discloses a nozzle cleaning device which blows a cleaning solvent against the nozzle portion of a printer head in an ink-jet printer. The ejecting unit includes a plurality of orifices, and a quantity of cleaning solvent is sprayed, by means of a piston, onto the nozzle of the printer head.

U.S. Pat. No. 4,567,494 discloses an ink-jet printer, the nozzles of which are primed and cleaned after each print line by engaging the nozzles with an elastomeric suction cup. The suction cup includes an inner cup of foam which wipes of any residual ink droplets. The cup is connected to a vacuum pump for drawing ink out of the nozzles.

U.S. Pat. No. 4,746,938 discloses an ink-jet printer having a heat washing unit disposed beyond one end of the printing area. The heat washing unit includes an ink mist suction unit which sucks ink mist around the ink-jet unit and the anti-clogging unit, which prevents clogging of the nozzles.

U.S. Pat. No. 4,814,794 discloses a cleaning device for the nozzle of an ink-jet printer, wherein cleaning liquid is supplied from a bag in a disposable cartridge and sprayed on the side of a nozzle in the printhead.

U.S. Pat. No. 4,829,318 discloses a maintenance system for purging and cleaning an ink-jet printhead, including a self-aligning purge nozzle which floats into positive engagement with a vent hole of the printhead, and a wiping roller about which a tape of wiping cloth passes.

U.S. Pat. No. 4,853,717 discloses a maintenance station for an ink-jet printer comprising a pump for priming the printhead, and wiping means for cleaning the printhead. The wiper is stationary relative to the apparatus, so that when the printhead on a carriage passes across the wiper in the carriage motion, the wiper is moved across the front face of the printhead.

U.S. Pat. No. 5,027,134 discloses the use of a wiper blade for cleaning conventional nozzle type ink jet printheads.

U.S. Pat. No. 5,084,712 discloses a maintenance system for an ink jet printer, including a solvent supply system for spraying solvent on the faces of the ink-jets and in the ink-jet openings, and a brush for scrubbing the ink-jet faces during and immediately after the spraying process. The solvent vapors enter the jets and deprime the jets so that the ink remaining in the jets drains out back into an ink reservoir.

U.S. Pat. No. 5,184,147 discloses an ink-jet printhead maintenance system having means for applying a vacuum to the ink-jet nozzles in the printhead. An elongated wiper engages and wipes the surface of the nozzles and is preferably moved at an extremely slow rate across the surface to enhance the wiping operation. A specialized drip edge is positioned beneath the orifice surface for directing drops of ink away from the ink-jet printhead which are generated during the cleaning procedure.

U.S. Pat. No. 5,644,347 discloses the use of a wiper blade for cleaning conventional nozzle type ink jet printheads.

U.S. Pat. No. 5,793,390 discloses a maintenance device using a wicking member for applying a cleaning liquid to nozzle openings.

As previously mentioned, an ink jet printhead configuration is significantly different from the printhead of an acoustic ink printer. Therefore, attempting to use a wiper blade cleaning device or other cleaning method or apparatus designed for nozzle type printheads will not achieve desired results. For example, use of a wiper blade cleaning devices with acoustic ink printheads may result in clogging of the printhead rather than accomplishing the desired cleaning.

It has also been suggested that a non-wiping technique for improving the cleanliness of exposed surfaces of droplet ejectors for a fixed printhead would be beneficial, as described in U.S. Pat. No. 5,287,126, commonly assigned hereto. However, while such a technique has benefits, it is less desirable for moving printheads and also involves significant engineering considerations and is more specifically designed to a fixed printhead situation.

Therefore, it has been determined desirable to find a method and apparatus of cleaning/maintaining acoustic ink printheads which have unique orifice plate design in which the ink menisci are maintained at an entrance edge of the orifice plate, defined by a very thin lip.

SUMMARY OF THE INVENTION

In accordance with the present invention, there is provided a method and apparatus for providing in combination or individually a flooding, dry and wet wiping of acoustic ink printheads for maintaining the cleanliness of the exposed surfaces of the printhead. A flooding procedure initially attempts to use a printheads own ink in the cleaning process. Following the flooding operation ink on the outside surface of the orifice plate is removed by use of wiping over it with a compliant wiper blade. Next, ink inside the orifice bore is removed using a wiping station in two separate steps. The wiping station of the present invention consists of a mechanism that allows clean, absorbent material to be positioned over the orifices before each wipe.

During a first step of the wiping station operation, the absorbent material is pushed lightly over the orifices with a soft/compliant roller while the printhead is moved and the printhead is held at a certain pressure. The dirty ink, because of higher pressure inside the printhead, is unable to reenter the printhead and is absorbed by the absorbent material. In a following step, pressure inside the printhead is decreased to enable the menisci to retreat inside the lip. When the orifice is again wiped with the absorbent material, the absorbent material is pushed with more force into the orifice using the compliant roller behind it. This enables the remaining ink to be removed from the bore of each orifice as well as from the exit surface of the submerged lip, due to absorption into the absorbent material. Subsequent to the second step wiping/cleaning method the pressure inside the printhead is increased/reset to the normal operating level to enable printing resumption.

In accordance with another aspect of the present invention, the apparatus for cleaning/maintaining AIP printheads is applicable for use with inks that when dried cannot be rinsed-away/refreshed (i.e. the wetting angle between the orifice lip and ink is significantly reduced and cannot be restored close to original) ink itself. In this embodiment, a previously supplied flooding step is augmented by a step of applying a cleaning material. In this step, the clean absorbent material has a substance applied. This absorbent material with the cleaning substance is then pressed into the orifice while the printhead moves across. Finally, the orifice plate is wiped clean again with a clean dry wipe cloth. The cleaning substance is of the type that can redissolve the dried ink such that removal of the cleaning substance restores the wetting/contact angle between the orifice lip surface and the ink.

BRIEF DESCRIPTION OF THE DRAWINGS

The invention may take form in various components and arrangement of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
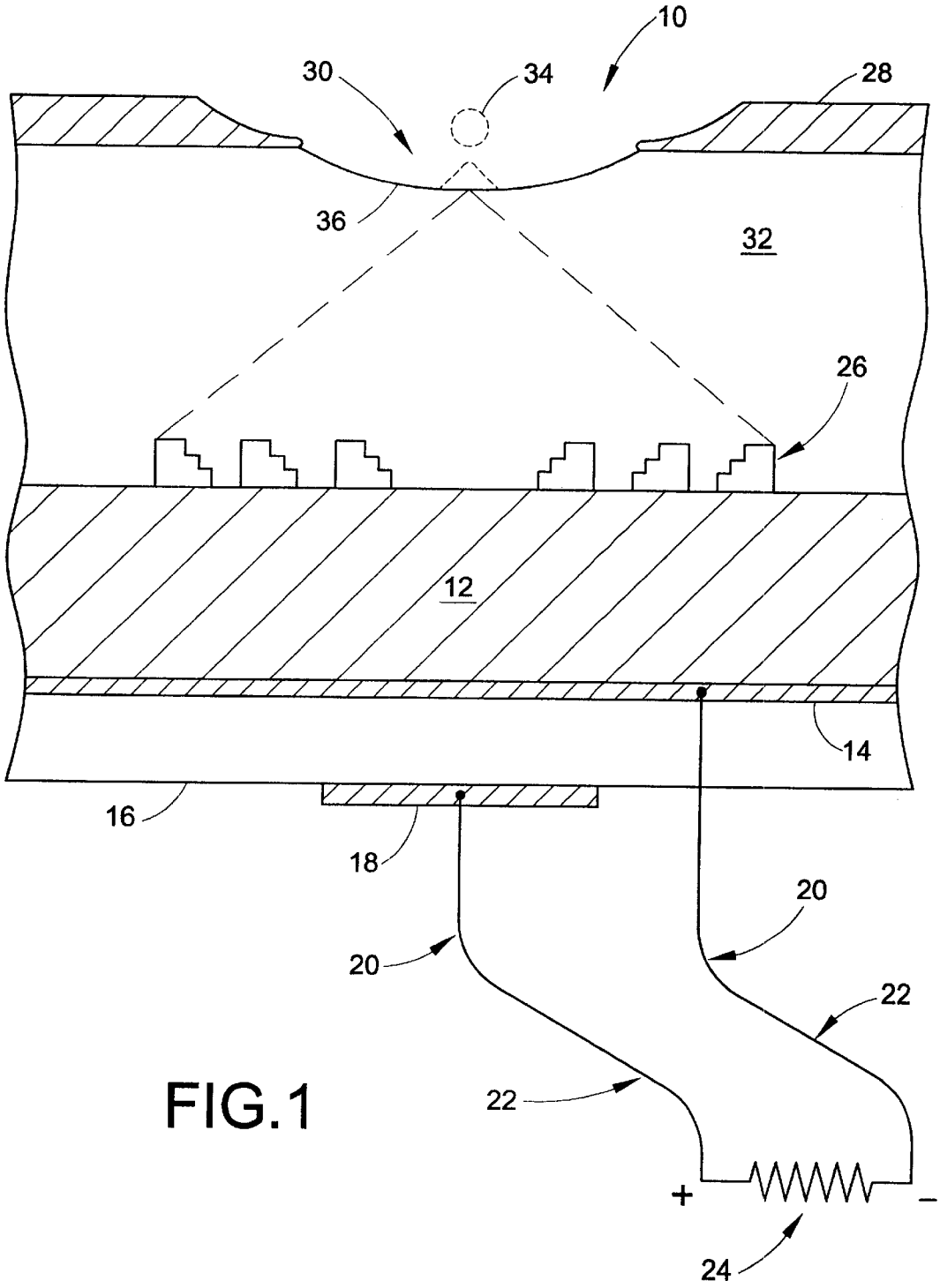
FIG. 1 is a representative illustration of an acoustic ink printing element to which the present invention may be applied.

FIG. 1 provides a view of an exemplary acoustic ink printing ejector 10 to which the present invention is directed. Of course, other configurations may also have the present invention applied thereto. Additionally, while a single ejector is illustrated, an acoustic ink printhead will consist of a number of the ejectors arranged in an array configuration, and the present invention is intended to work with such an array.

As shown, ejector 10 includes a glass layer 12 having an electrode 14 disposed thereon. A piezoelectric layer 16, preferably formed of zinc oxide, is positioned on the electrode layer 14 and an electrode 18 is disposed on the piezoelectric layer 16. Electrode layer 14 and electrode 18 are connected through a surface wiring pattern representatively shown by lines 20 and 22 to a radio frequency (RF) power source 24 which generates power that is transferred to the electrodes 14 and 18. On a side opposite the electrode layer 14, a lens 26, such as a concentric Fresnel lens or other appropriate lens, is formed. Spaced from the lens 26 is a liquid level control plate (as called on orifice plate) 28, having an orifice 30 formed therein. Ink 32 is retained between the orifice plate 28 and the glass layer 12. The orifice 30 is aligned with the lens 26 to facilitate emission of a droplet 34 from ink surface 36. Ink surface 36 is, of course, exposed by the orifice 30.

The lens 26, the electrode layer 14, the piezoelectric layer 16 and the electrode 28 are formed in the glass layer 12 through photolithographic techniques. The orifice plate 28 is subsequently positioned to be spaced from the glass layer 12. The ink 32 is fed into the space between the orifice plate 28 and the glass layer 12 from an ink supply (not shown but such supply is well known in the art).

Figure 2:
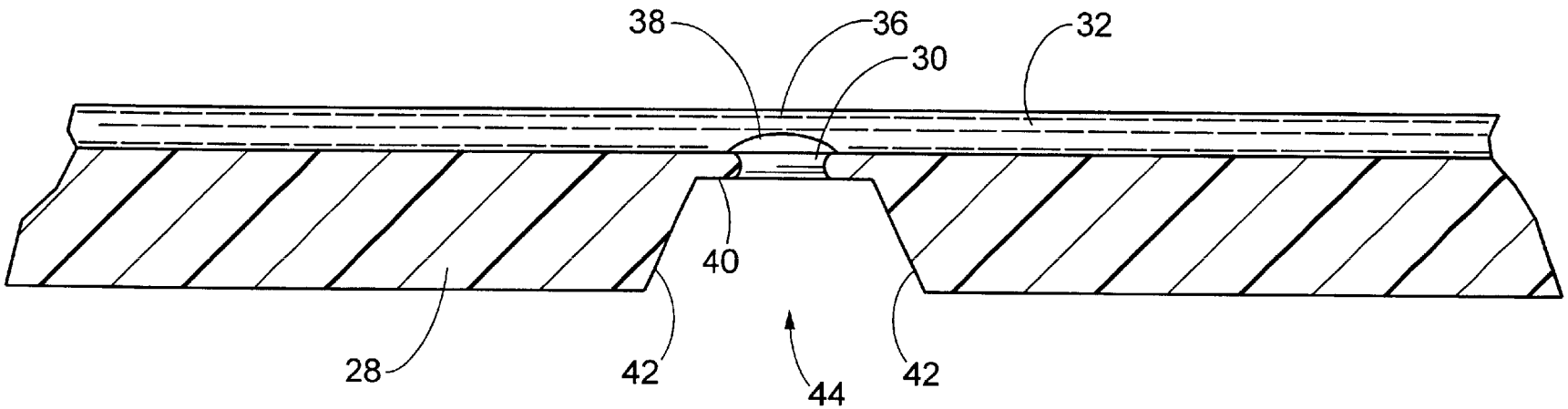
FIG. 2 is an orifice plate which is maintained by operation of the present invention.

Turning attention to FIG. 2, the orifice plate 28 shown is illustrated in more detail, wherein a submerged menisci 38 is maintained at an entrance edge of orifice plate 28 defined by a thin orifice lip 40. During the course of printing with the submerged menisci 38, the inside walls 42 of orifice bore 44 of each orifice 30, as well as the exit surface 46 of the orifice lip 40 can get dirty. As previously noted, due to the unique configuration of the orifice plate 28, existing wiper blade cleaning and other cleaning technology is not sufficient to ensure that an acoustic ink printhead will be sufficiently cleaned so as to assure operational reliability.

Figure 3:
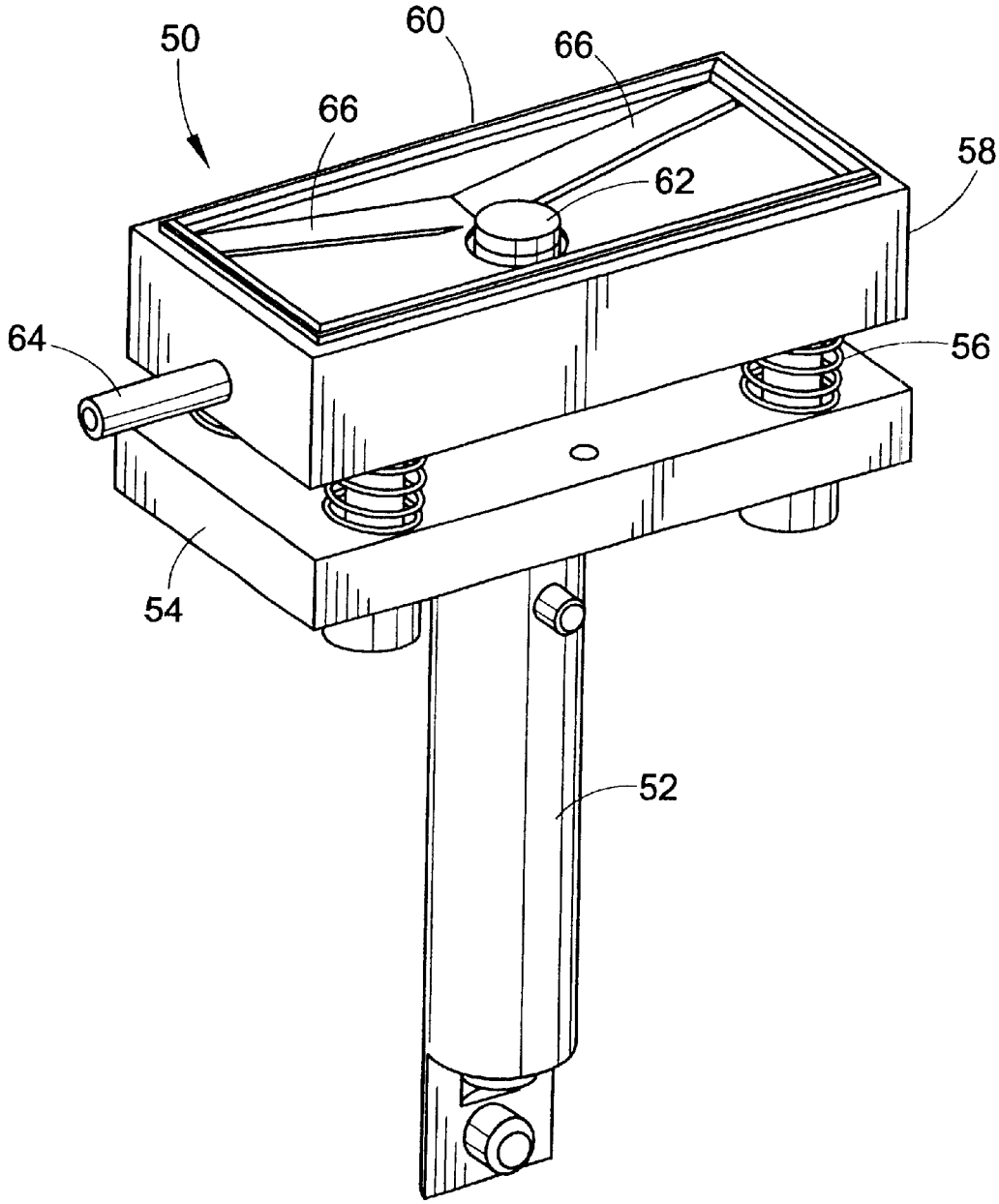
FIG. 3 depicts a capping element used as part of the apparatus and method of the present invention.

In seeking a manner of appropriately cleaning acoustic ink printheads such as those having an orifice plate 28 depicted in FIG. 2, applicants have enlisted the physical component of a capping structure such as that depicted in commonly assigned U.S. patent application Ser. No. 09/340,938, "A Method And Apparatus For Filling And Capping An Acoustic Ink Printhead", hereby incorporated by reference. This application discloses a capping structure 50 for rapidly filling an acoustic ink jet printhead, such as shown in FIG. 3. The capping structure 50 includes a plunger 52, a base 54, and springs 56 attached to a cap portion 58. The cap 58 includes a gasket seal 60, a valve 62, a drain nozzle 64 and wiper blades 66. During a filling operation, the gasket seal 60 is pressed against an orifice plate such as 28, but having an array of orifices 30. This traps a small volume of air around the orifices 30. During the fill/refill when ink enters the printhead the trapped air-cushion prevents the ink from exiting the orifices. The ink preferentially fills the printhead and exits the outlet path with no ink being spilled outside of the orifice hole. More details regarding the functioning of the capping structure for the fill/refill operations are disclosed in the co-pending U.S. patent application Ser. No. 09/340,938.

Figure 4:
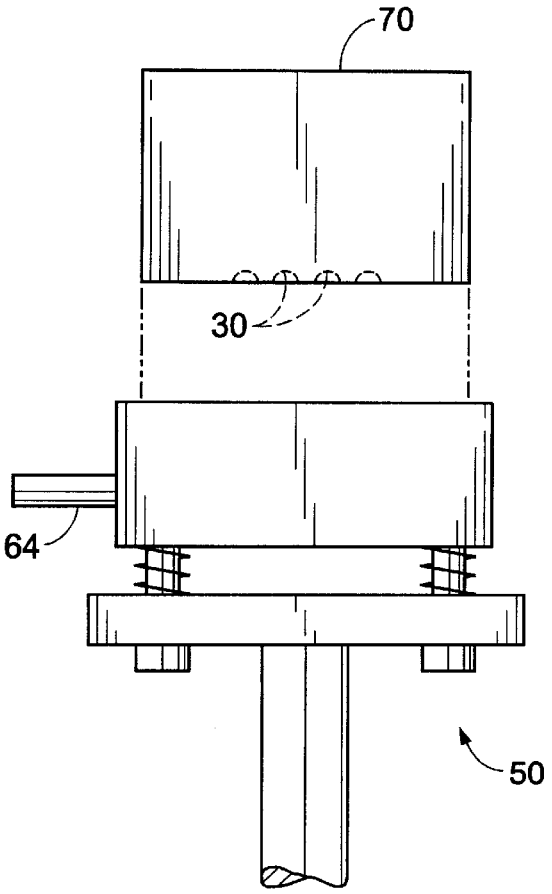
FIG. 4 illustrates a printhead array aligned with but not engaged with the capping element of FIG. 3.
Figure 5:
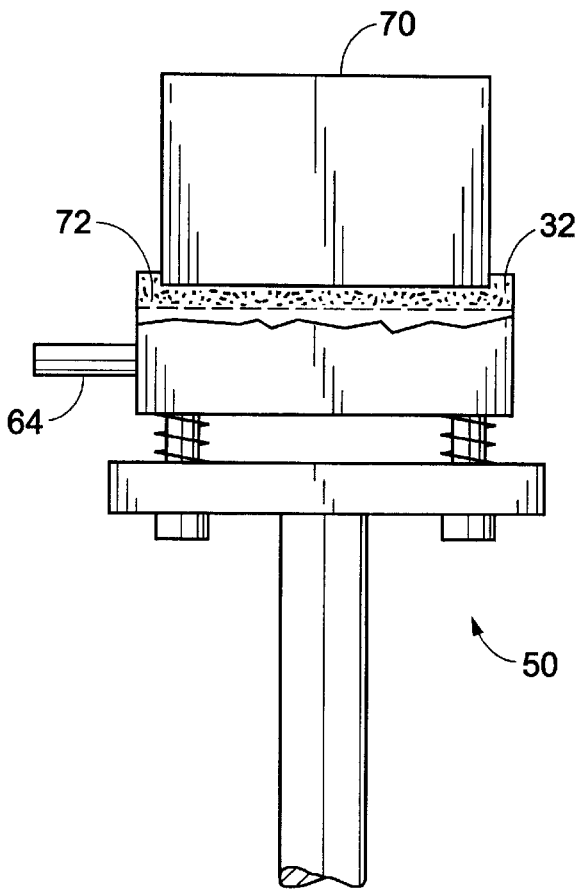
FIG. 5 illustrates the capping element and printhead array in a sealed capped arrangement.

In the present invention, capping station 50 is used in a first step of cleaning an acoustic ink printhead, such as comprised of a plurality of ejectors 10 previously described. As shown in FIG. 4, capping structure 50 is moved into alignment with printhead array 70, having a plurality of orifices 30, in a manner known within the art. Next, and as shown in FIG. 5, capping structure 50 is engaged with printhead 70 such as to form a seal. For the cleaning operation of the present invention, once the dirty printhead is capped, the ink pressure in the printhead is increased significantly to allow ink to escape through the orifices and completely fill a small space or gap 72 inside capped structure 50. It is to be appreciated that increasing ink pressure within the printhead is a known technique and accomplishable by one of skill in the art and understanding of acoustic ink printing. Once the pressure has been increased to move the ink through the orifice structures, the orifices may be allowed to soak for a predetermined time period in order to attempt to dissolve dried ink and loosen dust debris. After a predetermined time period, vent valve 62 is opened to drain the ink through drain nozzle 64 which had been forced by pressure out of the ink printhead. Once the ink has been pushed out through the orifices, the ink pressure inside the printhead is lowered to an intermediate higher level. This pressure prevents the ink still remaining inside the bore 44 of each orifice 30 (see FIG. 2) from reentering the printhead 70. Following this operation, the outside surface of the orifice plate may be cleaned off by wiping with the wiper blade 66. One embodiment of the wiper blade as a part of the cap chamber is disclosed in the aforementioned co-pending U.S. patent application Ser. No. 09/340,938.

Figure 6:
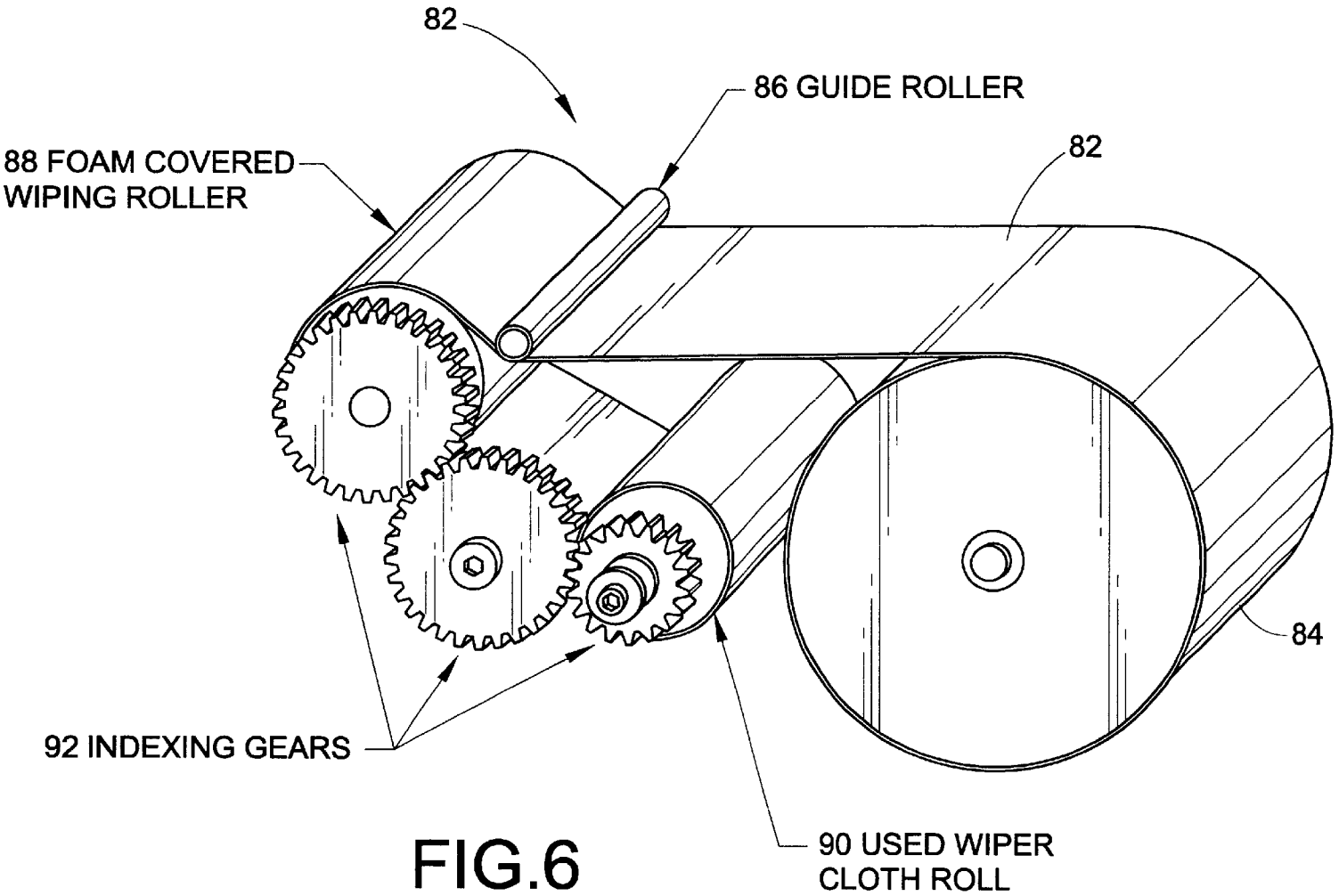
FIG. 6 is a first embodiment of the AIP printhead wiping station according to the teachings of the present invention.

Once the effort to clean the printhead 70 by flooding has been completed, additional cleaning is undertaken through the use of the wiping station 80 as shown in FIG. 6. It is to be appreciated that wiping station 80 of FIG. 6 may be part of the capping station or may be located at a separate area of the acoustic ink printer mechanism.

Turning more specifically to FIG. 6 and printhead wiping station 80, this device is anticipated by the inventors to be incorporated within an acoustic ink printer in a modular or cartridge type configuration. Particularly, it will be designed such that it may be simply plugged into the machine by a user and may be replaceable once used up.

AIP printhead wiping station 80 includes an absorbent material such as a fresh lint-free wiping cloth 82 on a roll 84. The cloth 82 passes by guide idler 86 and around compliant wiping roller 88 and finally gathered at used wiping cloth roll 90. The cloth is moved in this design through use of indexing gears 92, that index the wiping roller.

Figure 7:
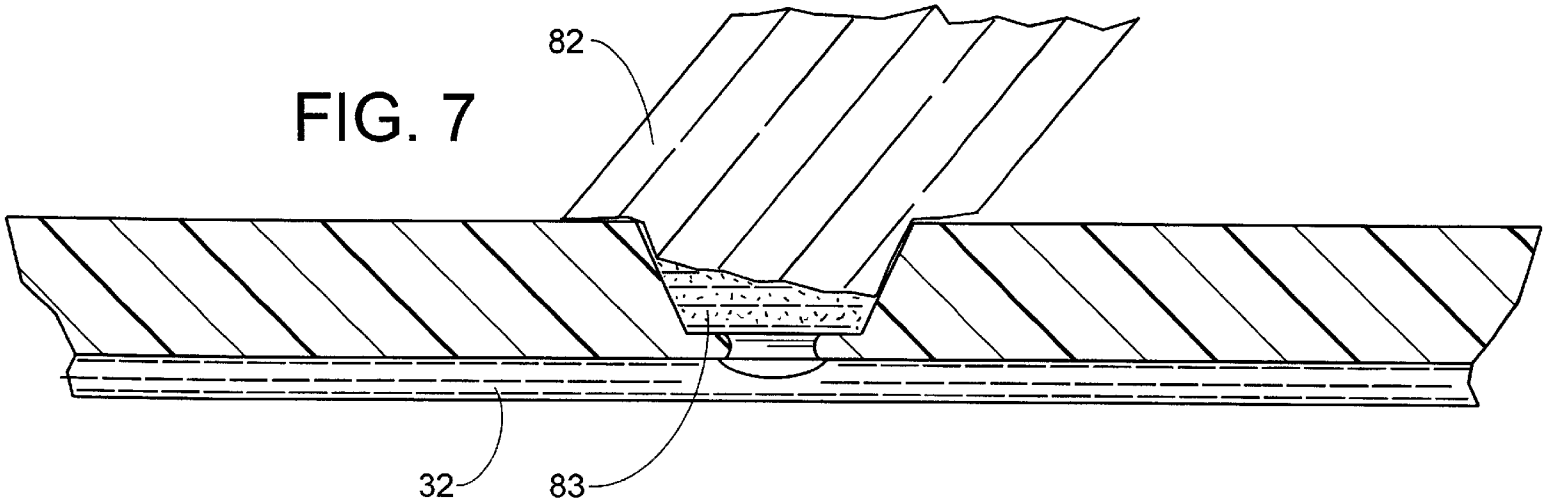
FIG. 7 depicts a first step in the operation of the printhead wiping station of FIG. 6.

Following the flooding operation used in conjunction with capping structure 50, the orifice plate 28 of printhead 70 is moved into engagement with the foam-covered wiping roller 88 of the AIP printhead wiping station 80, as shown in FIG. 7. The engagement of the foam-covered wiping roller 88 and orifice plate 28 is undertaken in order to remove ink inside the orifice bore 44, remaining from the flooding operation. Particularly, the AIP printhead wiping station 80 provides a two-step process to remove this undesirable ink. In the first step, a portion of the wipe cloth 82 which is over the foam-covered wiping roller 80 is pushed lightly over the orifice 30 while the printhead 70 is moving. By maintaining the higher pressure inside the printhead, the dirty ink 83 within the bore 44, is unable to reenter the printhead 70 and is therefore absorbed by the wipe cloth 82. This is understood to be a coarse wipe procedure, and in one embodiment, approximately ¾ of an inch of cloth is used to clean the orifice 30 and bore 44 of the dirtied ink.

Figure 8:
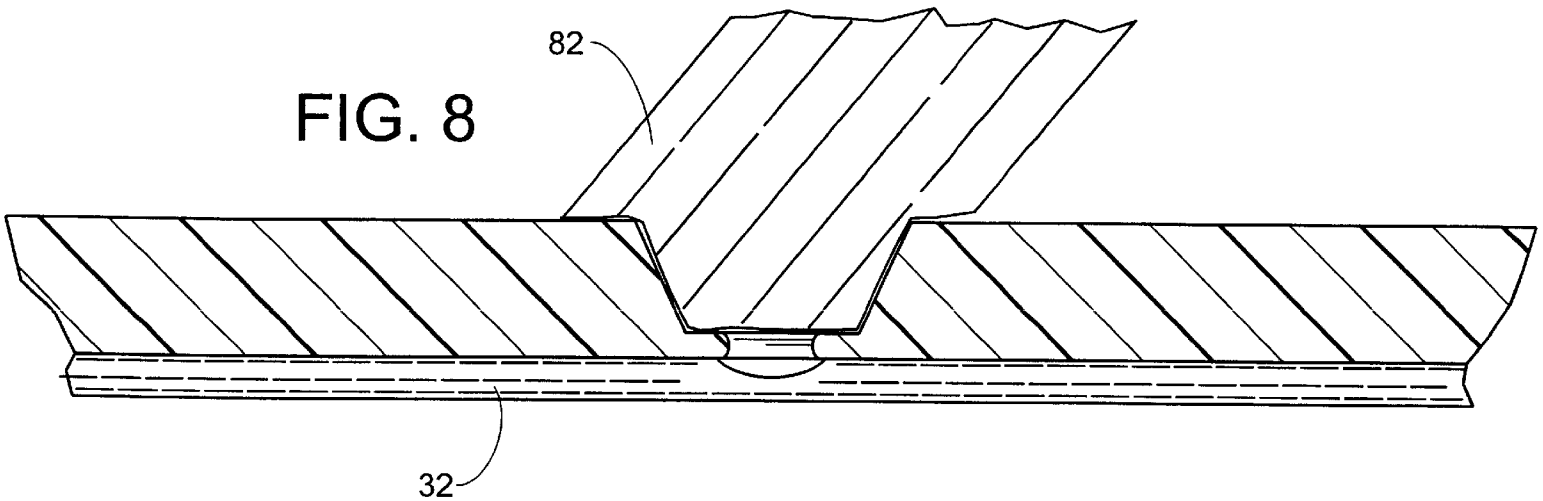
FIG. 8 illustrates a second step in the operation of the wiping station of FIG. 6.

In a second step, the pressure inside the printhead 70 is decreased significantly below operating pressures to enable a submerged menisci 38 to be formed inside the orifice lip 40. Then, as shown in FIG. 8 the orifice 30 is again wiped with a clean portion of wipe cloth 83, while the cloth is pushed with more force into the orifice 30, using the compliant foam-covered wiping roller 88. This enables the remaining ink to be removed from the bore 44 of orifice 30 as well as from the exit or outer surface of the orifice lip 46, due to absorption into wiping cloth 82. In this finer wiping step approximately ¼ of an inch of cloth is used.

Following this second step, the pressure inside the printhead is increased/reset to normal operating levels to enable resumption of printing.

It is to be noted that indexing gear 60 may be motivated by any one of a number of power sources such as represented by power source 62. It is also to be appreciated that movement of printhead 70 and foam-covered wiping roller 88 into engagement can be accomplished by many known mechanical operations. It should be noted that the indexing of the wipe material is done simultaneous to the wiping of the printhead. This means, as the printhead orifices are traveling past the wipe roller the wipe roller is also being rotated. This ensures fresh wipe material being introduced over the orifices and also reduces the friction between the printhead and the wiper by having more of a rolling friction than a static friction. This helps in reducing the wear force on the wipe material reducing the possibility of wiping material shreds, debris or fiber from gathering into the orifice.

Figure 9:
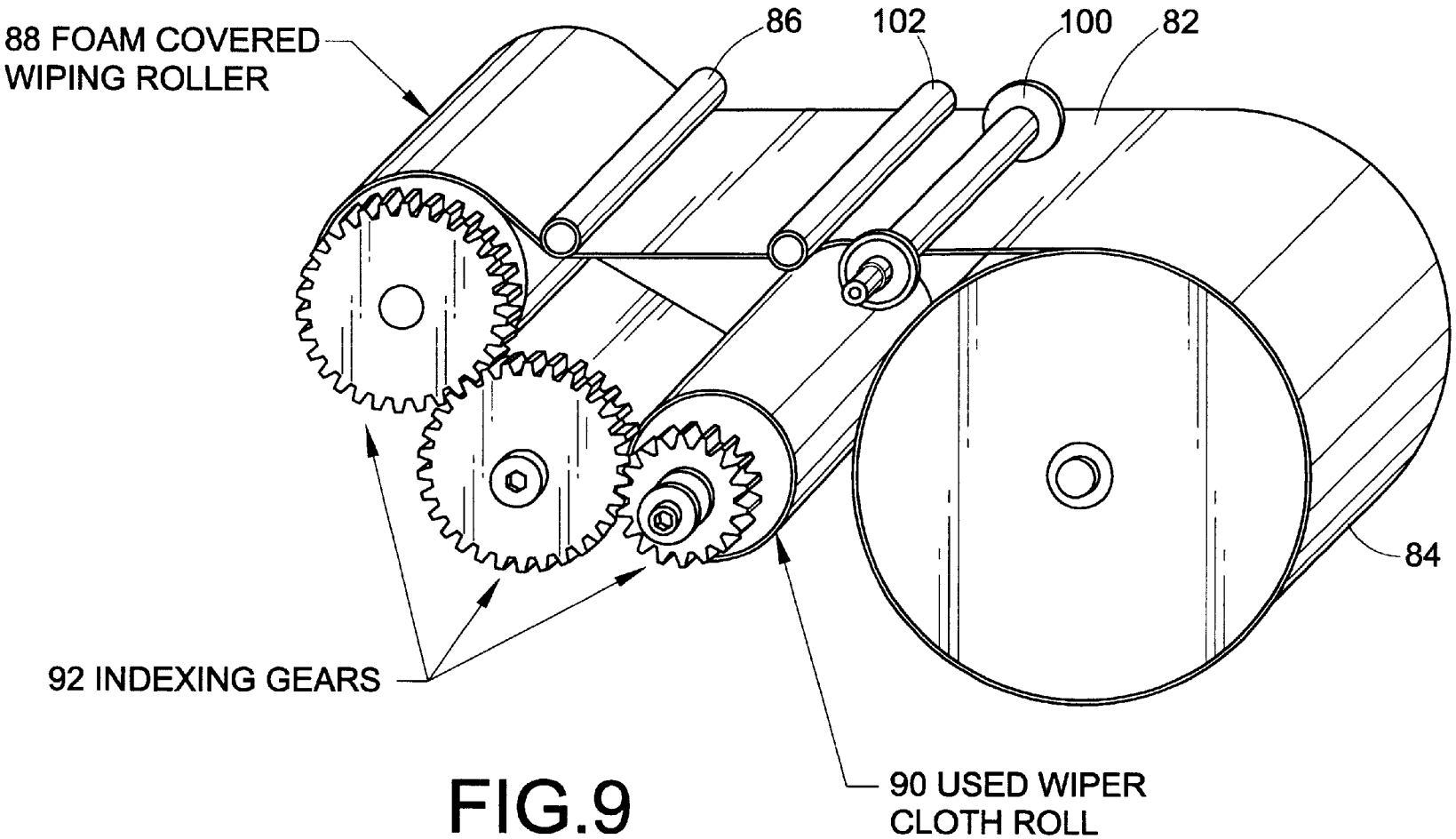
FIG. 9 is an embodiment of an AIP printhead wet wiping station according to the teachings of the present invention.

Turning attention to FIG. 9, a further embodiment describing a method and apparatus for cleaning/maintaining AIP printheads which have a submerged menisci is described. This method and apparatus is especially useful for printheads when used with inks of the type that when dried cannot be rinsed-away/refreshed (i.e. the wetting angle between orifice lip 38 and ink 32 is significantly reduced) and cannot be restored close to an original angle. These types of inks include waterfast inks and those known as aggressive, fast-drying inks.

In consideration of the present embodiment, the previous method of flooding the capping chamber to soak the printheads to remove dirty ink and other elements, and thereafter cleaning the printheads by using a dry, lint-free absorbing cloth is augmented by a wet-wiping step through the use of a washing fluid dispenser 100 as shown in FIG. 9. Particularly, many of the elements of FIG. 9 are similar to that of FIG. 6 and therefore do not need to be again discussed in detail.

In accordance with the procedure of this embodiment, the first gross dry-cleaning step may still be undertaken wherein approximately ¾ of an inch of clean, lint-free cloth 82 is used in the cleaning of orifice 30 of orifice plate 28, as previously shown in FIG. 7.

However, prior thereto, the clean-wiping cloth 82 may be first wetted with a cleaning solution from washing fluid dispenser 100. This clean-wetted wipe cloth 82 is then gently pressed into the orifice plate while the printhead moves across it. In a following step, the orifice plate may then be wiped clean again with a portion of the cleaning wipe cloth 82 (i.e. the fine cleaning which uses approximately ¼ of an inch of cloth). It is noted that the cleaning solution would be of the type that can re-dissolve the dried ink such that upon removal of the re-dissolved fluid, restoration of the wetting/contact angle between the orifice lip surface and the ink will be accomplished.

In the embodiment shown in FIG. 9, guide rail 102 is positioned in such a manner that when it is activated to move in a downward direction by a known motivating force, the clean cloth 82 is brought into contact with the washing fluid dispenser 100, the washing fluid dispenser in this embodiment shown to be a roll having a desired solution on its surface. By forcing the cloth 82 in a downward manner, the cloth comes into contact with the dispenser 100 thereby wetting cloth 82 with the desired solution.

Figure 10:
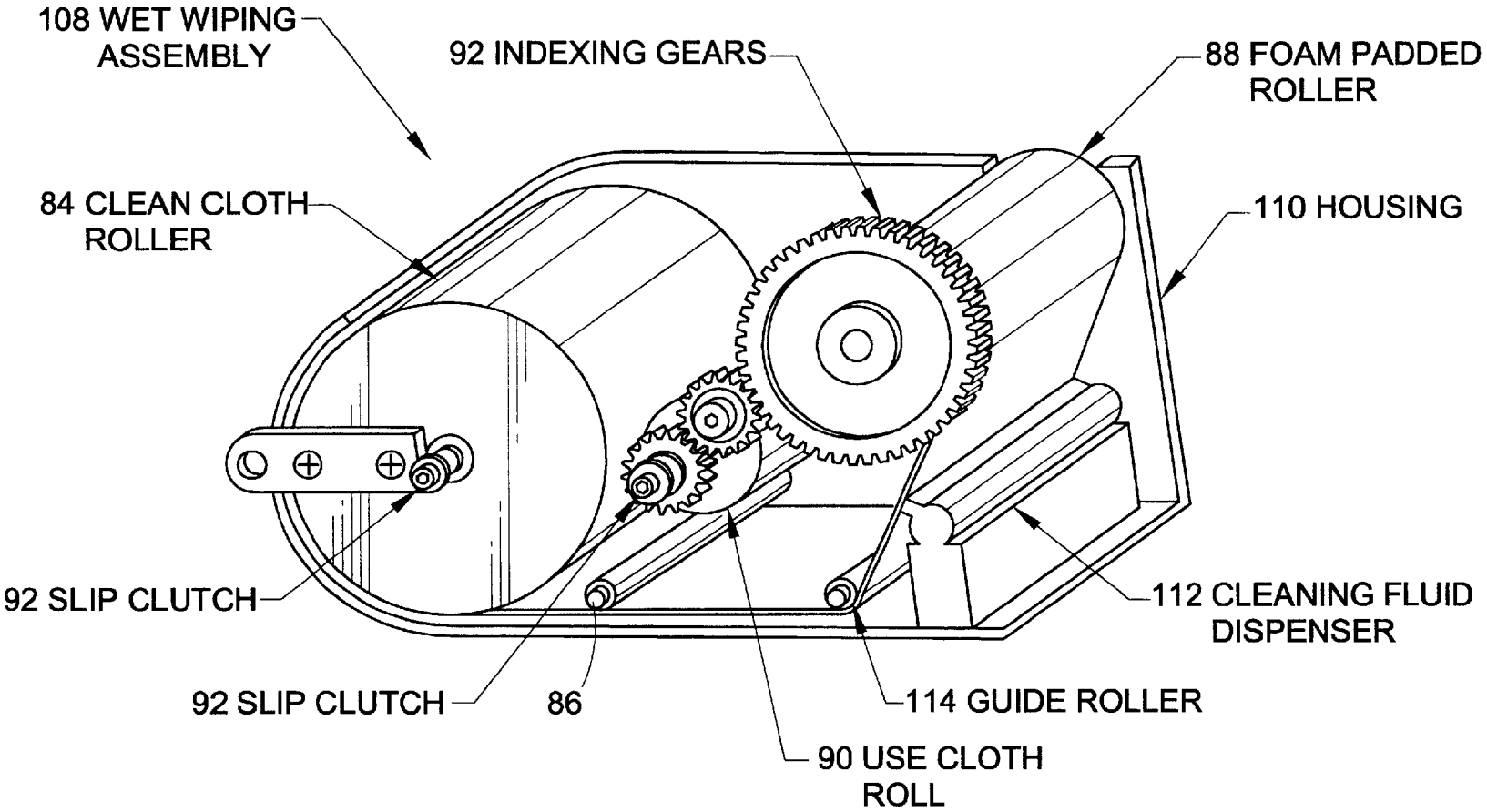
FIG. 10 illustrates another embodiment of a wet wiping station in a modular or cartridge configuration.

FIG. 10 depicts another embodiment of a wet wiping assembly 108 as described in the present invention. In this embodiment the assembly is shown in a cartridge-type arrangement. Particularly, housing 110 is depicted. This figure emphasizes an object of the present invention, which is to deploy the dry and/or wet wiping stations in a cartridge or modular form wherein they may be simply plugged into and removed from a printing device. Such operation is designed to be accomplished by a user upon an indication by the machine that a new cartridge is necessary. It is to be appreciated the amount of clean cloth 82 is of a finite amount and once this cloth is exhausted, a new cartridge will be necessary. It is also to be appreciated that an indication signal to inform a user may be accomplished in many ways including employing sensors to detect when the clean cloth is substantially exhausted.

It is to be further appreciated that while the cartridge assembly of FIG. 10 illustrates a wet wiping assembly, a dry wiping assembly 108 is also anticipated to be in such a cartridge format. In FIG. 10 the cleaning fluid dispenser 112 of this embodiment is of a significantly different form than that shown in FIG. 9. Particularly, in this embodiment, when a wet wiping sequence is required, guide roller 114 is made to be moved in a direction toward cleaning fluid dispenser 112. This movement causes a portion of cloth 82 to engage the cleaning fluid dispenser 112 in such a manner that the surface of the cloth is wetted. Thereafter, the normal procedures of a wetting operation are undertaken.

In the foregoing description, cleaning using the wet wiping station of FIGS. 9 and 10 have been described as having a coarse wet wipe which would use approximately ¾ of an inch of a clean cloth 82, then a finer dry wipe procedure, which uses about ¼ of an inch of cloth to remove the fluid. It is also possible to undertake the use of the wet wiping station of these figures in a two-step process wherein a coarse dry wipe is undertaken, then a wet wipe, followed by a third wiping step which is dry. As a further alternative the fine wipe (i.e. ¼ inch) can be a combination step. In particular, in this embodiment a wet final cleaning operation is undertaken and the surface of the printhead is then allowed to air dry.

While the foregoing discussion in FIGS. 9 and 10 have been directed to dispensing a type of fluid, in appropriate situations, the dispenser may dispense powder, paste, gels or other substances which may be useful in cleaning an acoustic ink printhead. Also, while the wiping assemblies of FIGS. 6, 9 and 10 have been described in connection with using a cloth, any type of absorbent material which can be rolled may be used, for example, a sponge-like material may also be useful in the present invention.

It is to be noted that in previous discussions of this document it was noted that using a wiper blade assembly designed for conventional ink-jet printers was inappropriate as it could cause blockage of orifices 30, the present invention does provide an optional capability of this procedure immediately following the flooding operation. The reason why this can be undertaken in the present invention is the use of the additional steps discussed in connection with the wiping stations. In particular, the use of the wiping blade following the flooding operation is not the final cleaning step. Rather, the remaining ink and debris that exists in the orifice of the printhead are absorbed by the use of the wiping stations as described.

The type of fluid which can be used in the dispensers described may be any sort of solvent which has been understood to remove the type of ink in the printer.

The described fluid dispensers may be designed in various fashions including a roller which is always maintained in a wet state or a type of roller where fluid is held inside the roller will move to the surface and release uniformly equal amounts upon pressure being applied to the roller surface, for a large number of release operations.

Further, while the present invention has shown singular wiping stations, in a color printing apparatus, the present invention may be implemented whereby a single wiping station may be used to clean printheads for a variety of colors (such as yellow, red, green or blue), or separate wiping stations may be used for each color. In particular, the wiping stations according to the present invention (both the dry wiping station and the wet wiping station) may be designed of such a size that all colors are cleaned by a single wiping station. In the alternative, individual wiping stations can be configured of a size to clean individual printheads of a printhead array.

It is to be further appreciated that the individual printhead wiping stations may be carried in a single cartridge.

The invention has been described with reference to the preferred embodiment. Obviously, modifications and alterations will occur to others upon reading and understanding the preceding detailed description. It is intended that invention be construed as including all such modifications and alterations insofar as they come Within the scope of the appended claims or the equivalents thereof.

Having just described the preferred embodiment, the invention is now claimed to be:

1. A method of cleaning a surface of an acoustic ink printhead, which holds ink between a lower glass substrate and an upper orifice plate, and which ejects droplets of the ink through orifices of the orifice plate when an acoustic wave of a predetermined magnitude is exerted on a free surface of the ink corresponding to the orifices, the method comprising:

moving a capping station having a cap portion into alignment with the printhead;

engaging a surface of the printhead and the cap portion so as to create a substantially air tight seal between the surface of the printhead and a surface of the cap portion, with a small gap area existing within the cap portion;

flooding the printhead by increasing ink pressure within the printhead to a level which causes ink to escape through the orifices and filling the small gap inside the cap portion;

maintaining the flooding step for a predetermined amount of time, whereby the ink acts to dissolve dried ink and loosen debris on the printhead;

altering and maintaining the ink pressure to an intermediate level which prevents the ink remaining inside a bore of each orifice from reentering the printhead;

opening a vent valve on the cap portion, to drain at least a portion of the ink which escaped through the orifices;

disengaging the capping station and the printhead;

aligning a wiping station and the printhead such that an absorbent material positioned around a compliant wiping roller is positioned across from the orifices;

a first wiping step including, pushing the absorbent material lightly over the orifices with the compliant roller, while the printhead is moved, whereby due to the pressure inside the printhead which does not allow the ink to reenter the printhead, the ink is absorbed by the absorbent material;

decreasing the pressure inside the printhead to a value substantially below operating pressure, whereby menisci retreats inside orifice lips of the corresponding orifices of the printhead;

a second wiping step including, pushing a new portion of the absorbent material onto the surface of the printhead with a force greater than the force of the previous pushing step, whereby pushing with a greater force allows the new portion of the absorbent material to absorb remaining ink into the new portion of the absorbent material from each orifice as well as from an outer surface of the orifice lips; and returning the ink pressure to normal operating level to enable resumption of printing.

2. The method according to claim 1 further including a step of applying a cleaning substance to the absorbent material, prior to the first wiping step.

3. The method according to claim 2 wherein the cleaning substance is at least one of a fluid solution, a powder, a gel, and a paste.

4. The method according to claim 2 further including a step of applying a cleaning substance to the new portion of the absorbent material, prior to the second wiping step.

5. The method according to claim 4 wherein the cleaning substance is at least one of a fluid solution, a powder, a gel, and a paste.

6. The method according to claim 4 further including allowing the printhead surface to air dry following the second wiping step.

7. The method according to claim 4 further including a step applying a third wiping step to remove the cleaning substance, following the second wiping step.

8. The method according to claim 1 wherein the wiping station moves the absorbent material a predetermined amount during the course of the first wiping motion, and moves the absorbent material a lesser amount during the course of the second wiping motion.

9. The method according to claim 1 further including the steps of:

generating an alert signal that the absorbent material has been fully used up;

removing the wiping station, which is in a configuration of a cartridge, from an acoustic ink printer; and inserting a new cartridge holding a new wiping station, into the acoustic ink printer.

10. The method according to claim 1 wherein the cleaning of the printhead is undertaken automatically upon the occurrence of a predetermined event.

11. The method according to claim 1 wherein the absorbent material is at least one of a cloth and a sponge.

12. The method according to claim 1 further including a step of using a wiper blade contained in the cap portion to clean the surface of the printhead.

13. A method of cleaning an orifice plate which is an upper surface of an acoustic ink printhead, and past which ink droplets are ejected from the printhead, comprising:

providing an ink pressure in the printhead which prevents ink inside a bore of each orifice hole from reentering the printhead;

aligning a wiping station and the printhead such that an absorbent material positioned around a compliant wiping roller is positioned across from the orifices;

pushing the absorbent material lightly over the orifices with the compliant roller, while the printhead is moved, whereby due to the pressure inside the printhead which does not allow the ink to reenter the printhead, the ink is absorbed by the absorbent material;

decreasing the pressure inside the printhead to a value substantially below an operating pressure, whereby menisci retreats inside the orifice lips of the corresponding orifices of the printhead;

pushing a new portion of the absorbent material onto the surface of the printhead with a force greater than the force of the previous pushing step, whereby pushing with a greater force allows the new portion of the absorbent material to absorb remaining ink into the new portion of the absorbent material from each orifice as well as from an outer surface of the orifice lips.

14. The method according to claim 13 wherein the orifice plate contains a plurality of orifices which are defined as countersunk holes and each orifice has a corresponding one of the orifice lips in which an ink menisci is maintained at an entrance level of the orifice plate, defined by the corresponding orifice lip.

15. The method according to claim 13 further including a step of applying a cleaning substance to the absorbent material, prior to the first pushing step.

16. The method according to claim 13 further including the steps of:

generating an alert signal that the absorbent material has been fully used up;

removing the wiping station, which is in a configuration of a cartridge, from an acoustic ink printer; and inserting a new cartridge holding a new wiping station, into the acoustic ink printer.

17. The method according to claim 13 wherein the cleaning of the printhead is undertaken automatically up on the occurrence of a predetermined event.

18. A maintenance assembly for cleaning a surface of an acoustic ink printhead, which holds ink between a lower glass substrate and an upper orifice plate, and ejects droplets of the ink through an orifice of the orifice plate when an acoustic wave of a predetermined magnitude is exerted on a free surface of the ink corresponding to the orifice, the maintenance assembly comprising:

a wiping station having a supply of wiping cloth on a roll, a compliant roller around which is moved the wiping cloth, a used wiping cloth roll around which is wrapped a used portion of the wiping cloth, and an arrangement of gears to selectively move the cloth from the wiping cloth roll, over the compliant roller to the used wiping cloth roll.

19. The maintenance assembly according to claim 18 further including:

a capping station having a cap portion sized to be larger than a size of a printhead with which it is to function, a gasket extending around an exterior area of the cap portion, a valve located within the body of the cap portion, a drain extending from the cap portion, a base, a spring assembly connected on one end to a lower surface of the cap portion and on another end to the upper surface of the base, and a plunger connected to a lower surface of the base.

20. The maintenance assembly according to claim 18 wherein the wiping station is configured as a plug-in replaceable cartridge.

* * * * *